US006205311B1

(12) United States Patent
Maess et al.

(10) Patent No.: US 6,205,311 B1
(45) Date of Patent: Mar. 20, 2001

(54) METHOD OF MULTICOLOR ELECTROPHOTOGRAPHIC PRINTING WITH UNIPOLAR TONER

(75) Inventors: Volkhard Maess, Erding; Martin Schleusener, Zorneding, both of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/284,709

(22) PCT Filed: Oct. 16, 1997

(86) PCT No.: PCT/DE97/02414

§ 371 Date: Jun. 17, 1999

§ 102(e) Date: Jun. 17, 1999

(87) PCT Pub. No.: WO98/18058

PCT Pub. Date: Apr. 30, 1998

(30) Foreign Application Priority Data

Oct. 17, 1996 (DE) ..... 196 42 891

(51) Int. Cl.[7] ..... G03G 15/01
(52) U.S. Cl. ..... 399/223; 399/178; 399/296
(58) Field of Search ..... 399/178, 223, 399/296, 129

(56) References Cited

U.S. PATENT DOCUMENTS 4,078,929 3/1978 Gundlach .
5,155,541 10/1992 Loce et al. .
5,303,009 * 4/1994 Nishizawa ..... 399/129 X
5,527,589 * 6/1996 Iijima et al. .
5,600,430 * 2/1997 Folkins et al. ..... 399/223 X

FOREIGN PATENT DOCUMENTS 44 08 978 A1 9/1994 (DE) .

OTHER PUBLICATIONS

Japanese Abstract No. 63265255, Katsuhiko, Nov. 1988.
Japanese Abstract No. 08044140, Yocichi, Feb. 1996.

* cited by examiner

*Primary Examiner*—Susan S. Y. Lee
(74) *Attorney, Agent, or Firm*—Sciff Hardin & Waite

(57) ABSTRACT

A method for multicolor electrophotographic printing includes a photoconductive layer system having surface elements or surface regions that are provided with an initial negative potential, then are exposed to varying degrees and developed with negatively charged toner particles of a color. A uniform light source is arranged closed to the photoconductive layer system and then the surface elements are developed with a second color toner. In particular, the image being printed has image elements of different colors which correspond to different surface elements of the photoconductor. These surface elements are differently illuminated to achieve different potentials and are developed by color particles by depositing the color particles on the respective surface elements. The charge potential of ones of the surface elements is increased and then surface elements not covered by color particles are illuminated to reduce the charge potential there prior to subsequent development of further surface elements.

4 Claims, 5 Drawing Sheets

140
B
R
G
W
142
144
146
148

150
VA
VA
VA
VA
S1
152
154
156
158

150
VB2*
VR2
VG2
VW2
S2

150
VR3
VG3
VW3
S3
152
154
156
158

150
VR5*
VG5
VW5
S5

150
VG6
VW6
S6
152
154
156
158

150
VG8*
VW8
S8

150
VW9
S9
152
154
156
158
142
144
146
148

160
S11

METHOD OF MULTICOLOR ELECTROPHOTOGRAPHIC PRINTING WITH UNIPOLAR TONER

BACKGROUND OF THE INVENTION

1. Field of the Invention

The present invention is directed to a method for the electrophotographic printing of a print image having a plurality of colors on a carrier, whereby the print image contains at least first image element with the color of the carrier, at least one second image element with a second color and at least one third image element with a third color. The first image element is allocated to a first surface element of a photo conductor layer. The photo conductor layer and an electrode layer carrying a predetermined reference potential are contained in a light-sensitive layer system. The reference potential is usually the zero potential. The second image element is allocated to a second surface element and the third image element is allocated to a third surface element of the photo conductor layer.

2. Description of the Related Art

A method for color printing is disclosed, for example, by U.S. Pat. No. 4,078,929. The method disclosed therein bears the name "Tri-Level Method". What is disadvantageous in this method is that only toner particles of two colors can be applied in a printing process. Moreover, the developer stations for applying the toner particles are operated with electrical polarities that are opposite one another. This requires additional structural measures at the developer stations, so that the developer stations are not identically constructed. The individual developer stations or, respectively, their component parts as well as the toners as well are thus not interchangeable, and the manufacturing outlay and servicing outlay is higher than given identical developer stations and identical toners.

Japanese Patent Application JP-63265255 discloses a printing method wherein toner particles of only one polarity are employed for the application of three colors. Before developing the second and the third color, the potential of the surfaces of the photoconductor that are not yet covered is respectively lowered by a total illumination. At the same time, the potential of the most recently developed surfaces is boosted.

U.S. Pat. No. 5,155,541 discloses a method wherein techniques of color photography and of the tri-level method are combined. A lowering of the potential by a total illumination with a lamp ensues between two developing steps with the same toner polarity.

German Published Application DE 44 08 978 A1 discloses methods for image generation wherein a total illumination and, potentially, an increase of the potential as well is implemented between developing steps with the same toner polarity. Various methods are explained wherein the total illumination is implemented either before or after the boosting of the potential.

Japanese Patent Application JP 08 044140 A discloses a printing method for a multi-color printing wherein a total illumination is implemented between two developing steps in order to lower the potential on areas of the photoconductor that have not yet been developed.

SUMMARY OF THE INVENTION

An object of the invention is to provide a simple method and an improved, simply constructed printer for printing at least three colors with high printing quality.

Given a method of the species initially cited, this object is achieved in a method for the electrophotographic printing of a print image with a plurality of colors on a carrier, whereby the print image contains at least a first picture element having the color of the carrier, at least one second image element having a second color and at least one third image element having a third color and at least one further picture element having a further color, a first surface element of a photo conductor layer is allocated to the first picture element, a second surface element is allocated to the second image element, a third surface element is allocated to the third picture element, and a further surface element is allocated to the further picture element, the photo conductor layer and an electrode layer carrying a predetermined reference potential are contained in a layer system; and in that the following steps are successively implemented in the indicated sequence:

S1) the surface elements are charged to a starting potential of a first polarity;

S2) the surface elements are differently illuminated such that, following the illumination, the third surface element has a third potential, the second surface element has a second potential that is higher in amount compared to the third potential, the further surface element has a further potential higher in amount compared to the second potential, and the first surface element has a first potential that is higher in terms of amount compared to the further potential;

S3) the surface elements are developed with color particles of the third color, whereby color particles of the first polarity and of the third color are deposited on the third surface element upon employment of a first auxiliary electrode that has a first auxiliary potential that is higher in terms of amount than the momentary potential on the third surface element and lower in terms of amount than the momentary potential on the second surface element;

S4) the surface elements are arranged close to a means for increasing potential, whereby the potential on the third surface element is increased in terms of amount after the application of the color particles of the third color, S5) the surface elements are arranged close to a light source having an approximately uniform light distribution, the third surface element covered with color particles is illuminated substantially less than the non-covered first surface element, the non-covered further surface element and the non-covered second surface element, and the momentary potential on the second surface element is reduced in terms of amount to a potential that is lower in terms of amount than the momentary potential on the third surface element;

S6) the surface elements are developed with color particles of the second color, charged color particles of the first polarity and of the second color are deposited on the second surface element upon employment of a second auxiliary electrode that has a second auxiliary potential that is higher in terms of amount than the momentary potential on the second surface element and lower in terms of amount than the momentary potential on the third surface element and the momentary potential on the first surface element;

S7) the surface elements are arranged close to a further means for increasing potential, the potential on the second surface element is increased in terms of amount after the application of the color particles of the second color;

S8) the surface elements are arranged close to a further light source, the non-covered further surface element is respectively considerably more illuminated that surface elements covered with color particles, and the potential on the further surface element is reduced in terms of amount to a potential that is lower in amount than the momentary potential on the second surface element;

S9) the surface elements are developed with color particles of the further color, color particles of the first polarity of the further color are deposited on the further surface element upon employment of a further auxiliary electrode that has a further auxiliary potential that is higher in amount than the momentary potential on the further surface element and lower in amount than the momentary potentials on the other surface elements. Compared to the known "tri-level method", the color particles of the first color and of the second color have the same polarity during developing in the invention. What this measure achieves is that the developer stations for applying the color particles of the first color and of the second color can be constructed essentially identically. The polarity of different assemblies and components in the printer is reduced by the invention compared to known printers having differently constructed developer stations. A simply constructed printer derives due to the invention.

In the present invention, the surface elements of a photoconductive layer are charged to a negative initial potential and are subsequently differently illuminated such that third surface element has a third potential after the illumination, a second surface element or region a second potential that is higher in amount compared to the third potential, and a first surface element or region has a first potential that is higher in terms of amount compared to the second potential. This different illumination is referred to as image-wise illumination. This graduation of potentials achieves that every color has exactly one value of potential allocated to it. A further image-wise exposing step wherein surface elements are irradiated with different optical energies can be omitted since an unambiguous allocation between values of potentials and colors is already present following an image-wise illumination step.

After the image-wise illumination, the photoconductive surface elements or regions in the invention are developed with color particles of the third color in a first developing step. Negatively charged color particles of the third color are thereby only deposited onto the third surface elements. No color particles are deposited onto the other surface elements. The third surface elements have the lowest potential in terms of amount (a more negative potential) at the point in time of this developing step. Accordingly, this is a matter of developing also referred to as discharged surface elements (discharged areas development). In the invention, the color particles are negatively charged in order to facilitate or, respectively, enable the selective deposit onto the third surface element.

After the first developing step, the photoconductive surface elements in the invention are arranged close to a light source. The arranging can, for example, be achieved by conducting the surface elements past the light source or by conducting the light source past the surface elements. However, static arranging of the surface elements relative to a light source with uniform light distribution is also possible. Either the surface elements of the layer system allocated to the print image are thereby simultaneously arranged opposite the light source or the surface elements are successively arranged opposite the light source, whereby, for example, surface elements that are allocated to image elements of a line region of an image can be simultaneously illuminated.

The invention is based on the perception that the developer stations can be identically constructed when, preceding one or more further developing steps, respectively the same or at least similar relationships of potential as preceding the first developing step are created. By depositing the negatively charged color particles on the photoconductor in the first developing step, the potential on the third surface elements is increased in terms of amount from its negative potential since charged color particles were applied onto these surface elements. The third surface elements covered with color particles in the exemplary embodiment of the invention are illuminated considerably less when arranged opposite the light source with uniform light distribution than are the non-covered surface elements, since the light does not penetrate through the deposited color particles or, respectively, penetrates through the deposited color particles only highly attenuated. The potentials of the first surface elements and of the second surface elements, however, are diminished in terms of amount since the incident optical energy is not absorbed by color particles. The potential on the second surface elements is lower in terms of amount (more negative) after the exposing step with the same optical energy than the momentary potential on the third surface elements. Accordingly, conditions similar to those that existed for the third surface elements before the first developing step are now present for the second surface elements.

In a second developing step in the invention, color particles of the second color are deposited onto the second surface elements. No color particles are deposited onto the first surface elements since the color particles are negatively charged for selective deposition as in the first developing step. When transferring the color particles deposited on the other surface elements onto the carrier in a later method step, the carrier remains free of color particles in areas that are allocated to the first surface elements in the transfer. As a result thereof, the print image ultimately has picture elements with the color of the carrier, for example, the paper.

The first picture element is forgone in that case wherein all picture elements of a print image are covered with color particles. In this case, all measures relating to the first element or, respectively, the first surface elements are eliminated.

In the invention, the print image contains at least one further picture element of a further color. The further picture element is allocated to a further surface element or region of the photo conductor layer. In the image-wise exposing step, the further surface element is illuminated such that it has a further potential after the illumination that is higher in terms of amount than the second potential and lower in terms of amount than the potentially present, first potential. By repeatedly arranging the layer system close to the light source or, respectively, close to further light sources, the further potential is lowered in steps until it is lower in terms of amount than the momentary potentials on the surface elements already covered with toner particles. In this condition, relationships are present for the further surface element that are similar to that before the first or, too, before the second developing step for the third or, respectively, the second surface element. In a further developing step, Color particles of the further color can therefore be deposited on the further surface element, similar to the procedure in the preceding developing steps. In particular, the developer stations are similarly constructed to perform each of the developing steps. This eliminated the need to manufacture different structural features for different developer stations.

Since developing is carried out at potential that is relatively low in terms of amount, the outlay for, for example, the electrical installation in the developer stations is low. In the invention, the number of developer stations with different colors is limited only by the height of the initial potential, since the potentials that are allocated to the individual colors should lie at least 300 V apart.

In the invention, the potential on the photoconductive surface element after the application of negatively charged color particles of the respective color onto at least one of the surface elements is increased in terms of amount, so that the differences between the developer stations are even slighter. The increase of the potential expediently ensues up to a value that lies somewhat below the respectively next higher potential in terms of amount. What can be achieved with measures known to a person skilled in the art is that the relationships of the potentials between the developer station and the surface element to be developed are essentially the same in all developing steps. Accordingly, only one version of the developer station, albeit in the required numbers, need be manufactured, so the manufacturing outlay thereby decreases.

The invention is also directed to a method wherein a positive starting potential is employed instead of the negative starting potential, whereby the respective momentary potentials on the surface elements have a positive operational sign instead of a negative operational sign. Moreover, positively charged color particles are employed instead of negatively charged color particles. The invention is thus directed to two potential curves on the surface elements that differ only in terms of the operational signs of the potentials. The technical effects are the same given both curves of potential.

In one exemplary embodiment of the invention, the carrier can be directly printed or, in another exemplary embodiment of the invention, the carrier can be indirectly printed with the assistance of an intermediate carrier, proceeding from which the particles are transferred onto the carrier. By employing an intermediate carrier, the light-sensitive layer system can be gently treated, since the material of the intermediate carrier can be selected such that minimum mechanical stressing of the surface of the photo conductor layer occurs given contact between intermediate carrier and layer system. For example, sheet-shaped material or continuous-form paper is employed as the carrier.

The invention is also directed to an electrophotographic printer having a light-sensitive layer system that contains an electrode layer carrying a predetermined reference potential and a photo conductor layer, a charging means for generating a starting potential on the photo conductor layer, an illumination means for the image-wise illumination of the photo conductor layer, a first developer station for applying color particles of a polarity and a color onto the layer system, at least two total illumination units for the uniform illumination of the layer system, at least two means for increasing potential for boosting the amount of only the respectively lowest potential in terms of amount on the layer system, and having at least two further developer stations for applying color particles of the polarity and further colors onto the layer system, wherein the total illumination units and the means for increasing potential as well as the further developer stations are arranged such that a surface strip of the layer system lying transverse relative to the conveying direction of the layer system is respectively conducted first past a means for increasing potential, then past a total illumination unit and subsequently past a further developer station. The aforementioned effects with respect to the method also apply to the printer of the invention. The printer of the invention has a simple structure. In particular, the photoconductive layer system is constructed of only two layers, and only one image-wise exposing step is needed per print image, so that only one image-wise exposing unit with a simple control is required.

The invention can be implemented with a dry toner that contains only solid color particles, or with a liquid toner in which the color particles are contained in a liquid.

BRIEF DESCRIPTION OF THE DRAWINGS

The invention is described below with reference to exemplary embodiments.

DETAILED DESCRIPTION OF THE PREFERRED EMBODIMENTS

Figure 1:
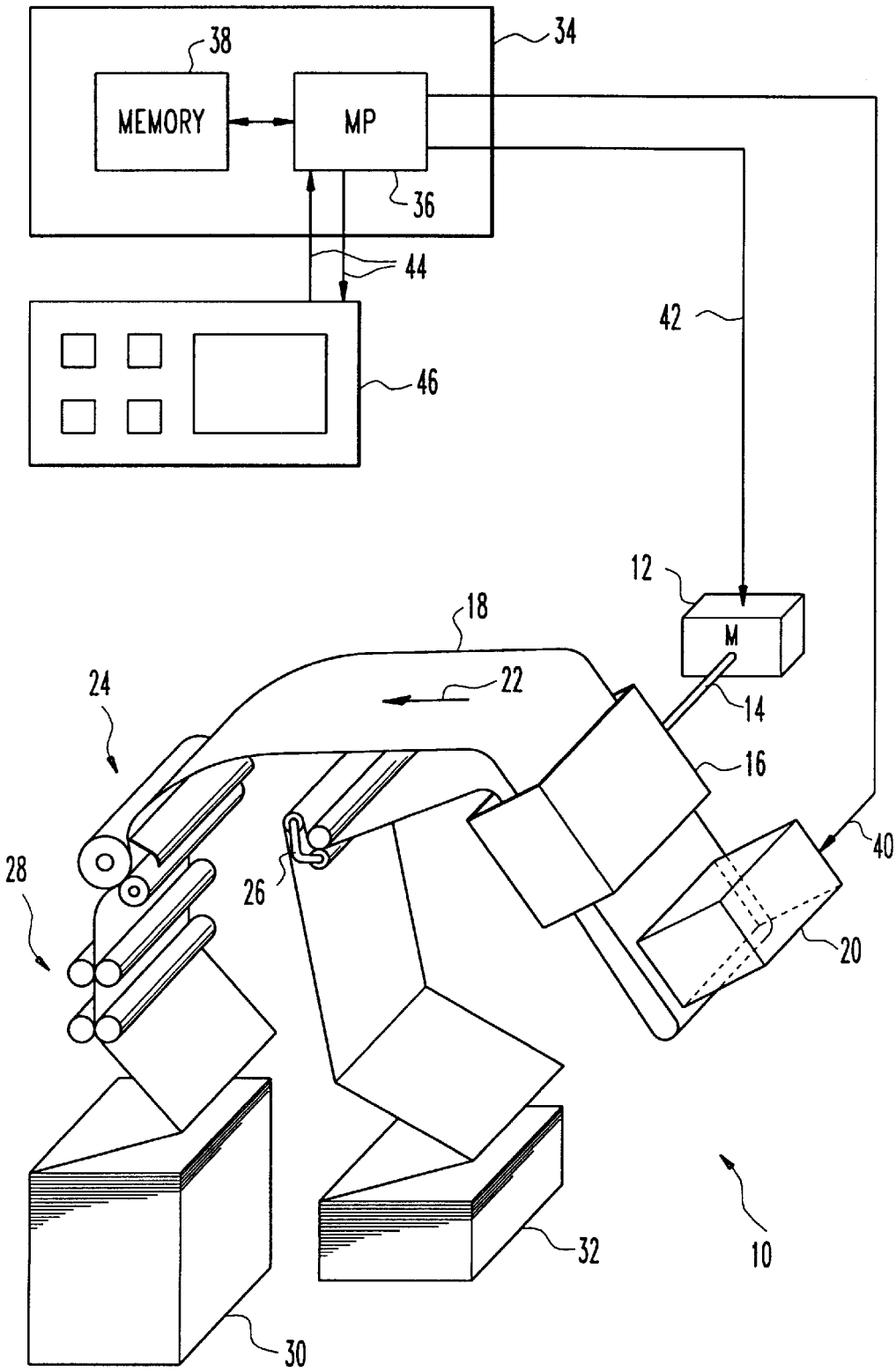
FIG. 1 is a schematic illustration of an electrified graphic printer with critical electronic and mechanical function units.

FIG. 1 shows a schematic illustration of an electrophotographic printer 10 for the implementation of an exemplary embodiment of the method of the invention. The printer 10 has a conveyor means 16 driven by a motor 12 and a shaft 14 for conveying a continuous-form carrier material 18 past a printing unit 20 essentially according to a predetermined printing speed VD. Alternatively to the continuous-form carrier material 18, single sheets can also be printed given a modified transport. The printing unit 20 generates a multicolored toner image that, for example, is transferred onto the carrier material 18 with the assistance of a transfer printing corona means (see FIG. 2).

After the carrier material 18 has been conveyed past the printing unit 20 in the direction of an arrow 22 illustrating the conveying direction, it is supplied to a fixing station 24 in which the still smearable toner image is fused smear-resistant to the carrier material 18 with the assistance of pressure and temperature. As viewed in the conveying direction 22, a first deflection unit 26 is arranged preceding the printing unit 20, this conducting the carrier material 18 to the printing unit 20. A further deflection unit 28 stacks the printed carrier material 18 onto a stack 30. The carrier material 18 is taken from a stack 32 by the first deflection unit 26 at the beginning of the printing process. Instead of the two stacks 30 and 32, rolls are also employed on which the carrier material 18 is rolled up.

The printing process is controlled by a print control 34 that contains at least one microprocessor 36 and one memory 38. The microprocessor 36 processes a printing program deposited in the memory 38 and thereby controls the printing process. The print control 34 also edits image data likewise stored in the memory 38 and transfers the edited image data via a control and data bus 40 to the printing unit 20. The motor 12 is driven such by the print control 34 via a control line 42 that the carrier material 18 has a conveying speed that essentially coincides with the printing speed VD. The print control 34 is connected via data lines 44 to an input/output means 46 via which, among other things, control commands for starting the printing process are input by an operator.

Figure 2:
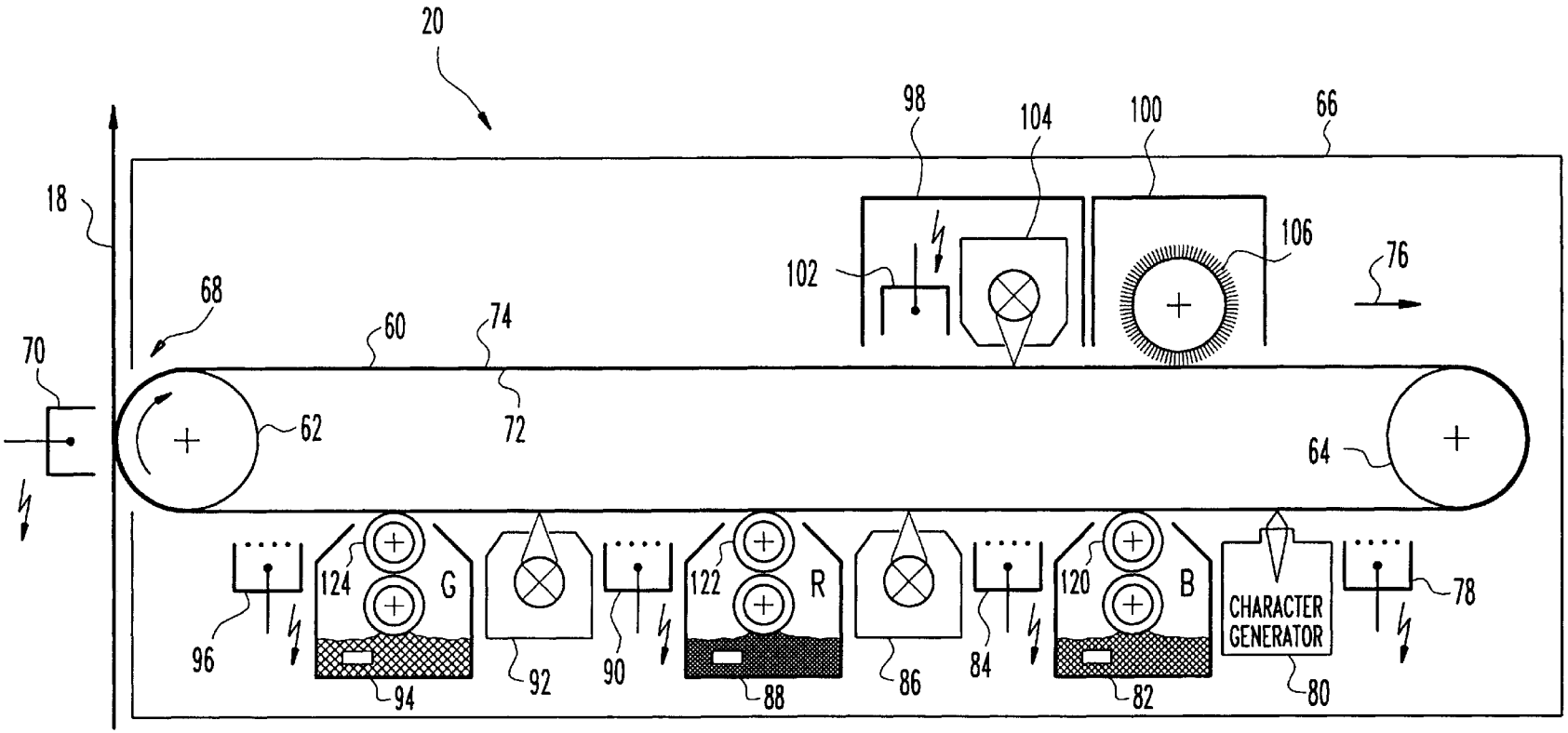
FIG. 2 is an enlarged schematic view of the printing unit of the printer with critical functional components.

FIG. 2 shows the printing unit 20 of the printer 10 with its critical functional components. The printing unit 20 contains a photo conductor 60 that is composed of a flexible layer system and is guided around two deflection rollers 62 and 64 in the fashion of a conveyor belt. The deflection roller 64 is driven by a drive motor (not shown) that is driven by the print control 34 and via the control and data bus 40. The printing unit 20 is surrounded by an opaque chassis 66 of a stable material. The chassis 66 has an opening 68 at which the photo conductor 60 is conducted past in the inside of the printing unit 20. Outside the printing unit 20, the carrier material 18 is conducted past at the opening 68. No light can impinge onto the photo conductor 60 from the outside through the opening 68 since the entire printer 10 has an opaque cladding. The opening 68 has a corona means 70 lying arranged opposite it, a toner image located on the photo conductor 60 being transferred onto the carrier material 18 with the corona means 70. The corona means 70 is also referred to as transfer printing means.

The photo conductor 60 contains an electrode layer 72 carrying a zero potential and a photo conductor 74 arranged approximately parallel thereto that is in mechanical and electrical contact with the electrode layer 72 in large-area fashion. The photo conductor 60 is moved in the direction of an arrow 76 by the deflection rollers 62, and 64. a give surface strip region of the photo conductor 60 lying transversely relative to the conveying direction of the photo conductor 60 is thereby successively conducted past a charging means 78, a character generator 80, a developing station 82 for depositing blue toner particles, a charging means 84, a total exposing unit 86, a developing station 88 for depositing red toner particles, a charging means 90, a total exposing unit 92, a developer station 94 for depositing green toner particles, a recharging station 96, the corona means 70, an erasing means 98 and a cleaning means 100.

Figure 3:
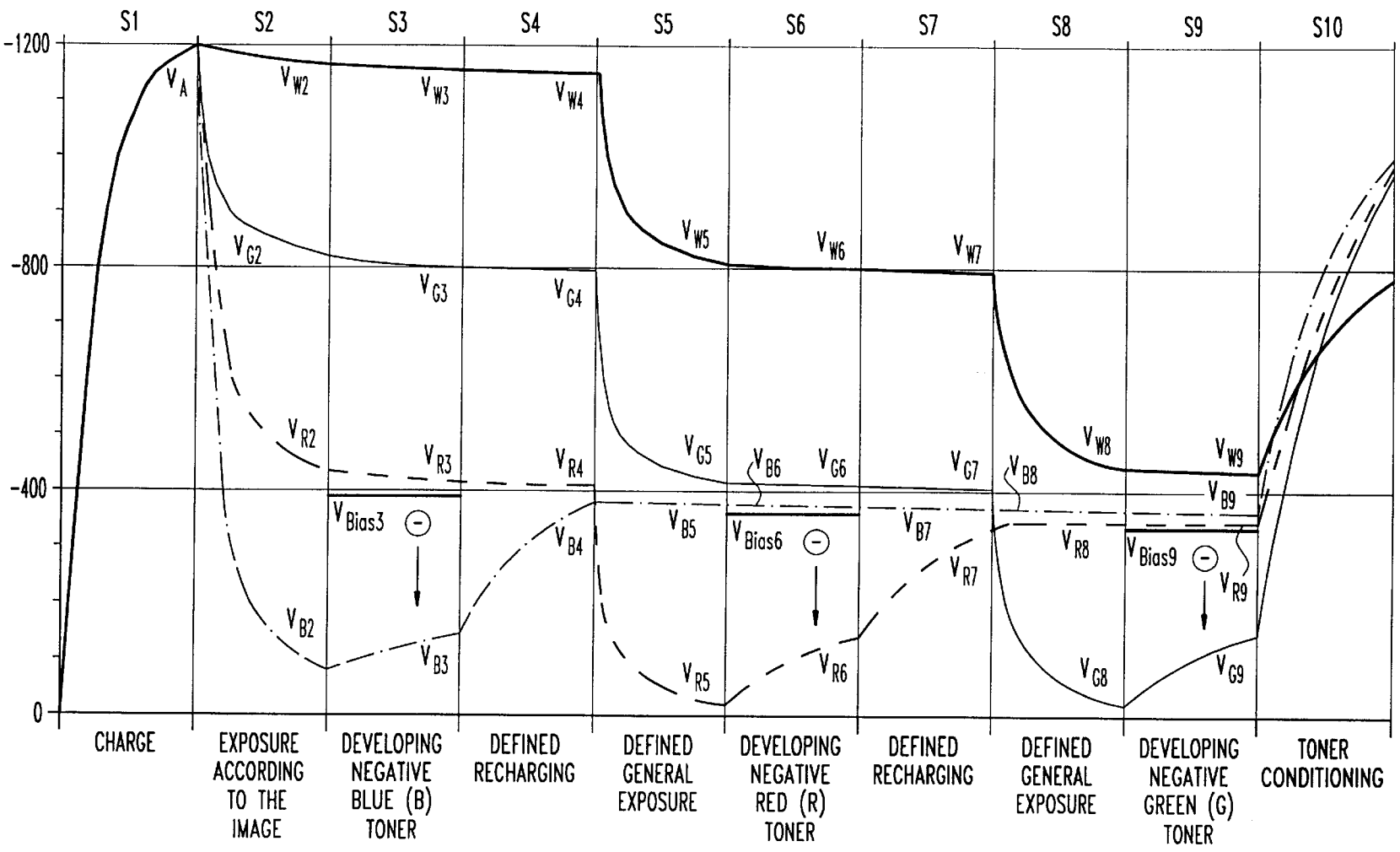
FIG. 3 is a graph of the curve of potential on the surface elements of the photo conductor in an exposing step and a toner polarity.

The charging means 78 contains a corona means arranged transversely relative to the conveying direction 76 that charges a surface strip of the photo conductor 60 lying respectively transversely relative to the conveying direction 76 and located in the immediate proximity of the charging means 78 such that an initial potential VA of approximately −1200 V arises 12 on the surface of the photo conductor 74 in the region of the surface strip (see FIG. 3, step S1).

The character generator 80 contains a line of light-emitting diodes arranged transversely relative to the conveying, direction 76 that respectively illuminate a region of the photo conductor 60 image-wise lying transversely relative to the conveying direction 76. The character generator 80 is driven such by the print control 34 such that respective image signals for picture elements of a line of the print image are simultaneously converted into luminous signals of the light-emitting diodes. Due to the illumination of the photo conductor 60, the potential on the illuminated surface elements of the photo conductor 60 rises since the photo conductor 60 conducts better in the illuminated regions, as a result whereof charged carriers can flow from the surface of the photo conductor layer 74 to the electrode layer 72 in the region of the illuminated surface elements or regions. Surface elements on which no toner particles are to be deposited are not illuminated; surface elements or regions on which green toner particles are to be illuminated are illuminated with a first optical energy; surface elements or regions on which red toner particles are to be deposited are illuminated with a second luminous energy that is higher compared to the first luminous energy, and surface elements or regions onto which blue toner particles are to be deposited later are illuminated with a third luminous energy that is higher compared to the second luminous energy. With increasing luminous energy, the potential on the respective surface elements or regions increases more greatly (i.e. the potential varies in a positive direction), since the photo conductor increasingly conducts better (see FIG. 3, step S2).

The developer station 82 deposits negatively charged color particles having the color blue B onto surface elements that were illuminated with the third luminous energy, depositing them thereon upon employment of an auxiliary electrode 120 having a potential VBIAS3. The exact functioning mechanism is explained later with reference to FIG. 3 (step S3).

Due to the deposit of the negatively charged, blue toner particles, the potential on the surface elements that were illuminated with the third luminous energy is again lowered, i.e. modified in a negative potential direction. In order to lower the potential on these surface elements even farther, the photo conductor 60 is conducted past the charging device 84. The charging device 84 contains a corona wire stretched transversely relatively to the conveying direction 76 that has a potential that effects a charging of the surface of the photo conductor layer 74 to a potential VB4 in the region of the surface elements covered with blue toner particles. The potential VB4 is somewhat smaller in terms of amount than the momentary potential VR4 on the surface elements that were illuminated with the second luminous energy (see FIG. 4, step S4).

Subsequently, the strip of the photo conductor 60 under consideration is conducted past the total illumination unit 86. The total illumination 86 contains a laser diode that beams optical energy into an optical fiber array arranged transversely relative to the conveying direction 76 of the photo conductor 60. The optical fiber array is fashioned such that essentially the same optical energy is beamed out over its entire length. The light of the total illumination unit 86 cannot beam through blue toner particles that have already been deposited since it is absorbed by the toner particles. When the light of the total illumination unit 86, however, impinges surface elements of the photo conductor layer 74 that are not yet covered with toner particles, then the potential on these surface elements is increased, i.e. it is modified in a positive direction (see FIG. 3, step S5).

The developer station 88 deposits negatively charged toner particles having the color red R onto surface elements that were illuminated with the second luminous energy, depositing these with the assistance of an auxiliary electrode 122 having a potential VBIAS6. The exact functioning of the developer station 88 is likewise explained later with reference to FIG. 3 (step S6).

Due to the application of the negatively charged, red toner particles, the potential on the surface elements that were illuminated with the second optical energy is lowered. In order to lower the potential on these surface elements farther, the photo conductor 60 is conducted past the charging means 90. The charging means 90 is constructed essentially like the charging means 84. The corona wire in the charging means 90 has a potential that effects a charging of the surface of the photo conductor layer 74 to a potential VR7 in the region of the surface elements covered with red toner particles. The potential VR7 is somewhat smaller in terms of amount than and the momentary potential VB7 on the surface elements covered with blue toner particles (see FIG. 3, step S7).

Subsequently, the photo conductor 60 is conducted past the total illumination unit 92. The total illumination unit 92 is constructed essentially like the total illumination unit 86. Due to the total illumination unit 92, the potential on the surface elements that are not yet covered with toner particles is lowered. This applies to surface elements that were illuminated with no optical energy or with the first optical energy (see FIG. 3, step S8).

The developer station 34 deposits negatively charged toner particles having the color green G onto the surface elements of the photo conductor 60 illuminated with the first optical energy. An auxiliary electrode 124 having the potential VBIAS9 is thereby employed. The exact functioning of the application of the green toner particles is likewise explained later with reference to FIG. 3 (step S9).

In the recharging station 96, the potentials on the surface elements covered with toner particles arc lowered to approximately the same value, whereby the potentials on the surface elements shift in a negative potential direction (see FIG. 3, step S 10). The potential of the surface elements not covered with toner particles is thereby also lowered. What is achieved by this measure is that the transfer of the toner image from the photo conductor 60 onto the carrier material 18 is reliably implemented with the assistance of the corona means 70.

After the transfer of the toner image with the assistance of the corona means 70, the photo conductor 60, which is now essentially free of toner particles, is conducted past the erasing means 98. The erasing means 98 contains a corona means 102 and an illumination unit 104 with which the residual charges which may be present on the photo conductor 60 are removed.

Toner particles that still remain on the photo conductor 60 after the transfer of the toner image are removed from the photo conductor 60 in the cleaning means 100 with the assistance of a brush 106. After being conducted past the cleaning means 100, the strip of the photo conductor 60 under consideration is again in a clean initial condition and has approximately the same potential at all locations.

FIG. 3 shows the curve of potential on the surface of the strip of the photo conductor 60 under consideration given an illuminating step and one toner polarity. The time, which is subdivided into ten successive time steps S1 through S10 is displayed progressively on the abscess axis. The potential on the surface of the photo conductor layer 74 with respect to the potential on the electrode layer 72 is shown on the ordinate axis.

In step S1, the potential on the surface of the photo conductor layer 74 is shifted in a negative direction to the initial potential VA due to the influence of the charging means 78, the initial potential VA having the value of −1200 V as already mentioned.

In step S2 the image-wise illuminating ensues with the assistance of the character generator 80, as a result thereof the curve of potential that is shown is established on the surface of the photo conductor layer 74. Surface elements that are not to be covered with toner particles later are not illuminated. The potential VA on these surface elements rises (becomes more positive) only slightly during the course of the step S2 to a value VW2 due to a self-discharge of the photo conductor 60 that cannot be suppressed. The potential on the surface elements that were illuminated with the first optical energy rises (becomes more positive) to a value VG2 of approximately −800 V. The potential on the surface elements that were illuminated with the second optical energy rises (becomes more positive) during the course of the step S2 to a value of potential VR2 of approximately −400 V. The potential on the surface elements that were illuminated with the third optical energy rises to an approximate potential value VB2 of approximately −100 V in the step S2.

In step S3, negative blue toner particles are deposited by the developer station 82. The auxiliary electrode 120 in the proximity of the photo conductor 60 has the auxiliary potential VBIAS3 of approximately −390 V. The negatively charged, blue toner particles are situated on the auxiliary electrode 120. Since the potential VBIAS3 is higher (more positive) than the potentials VB2, VG2 and VR2, these potentials are negative with respect to the potential VBIAS3. The negatively charged, blue toner particles, however, can only be deposited on a surface that has a higher or positive potential with reference to the potential VBIAS3. This is only true of surface elements that were illuminated with the third optical energy level in the step S2. Accordingly, the blue toner particles are deposited on these surface elements. Due to the deposit of the negatively charged toner particles, the potential on the surface elements covered with the blue toner particles is lowered to a potential value VB3. Due to the unavoidable self-discharge of the photo conductor 60, the potentials VW2, VG2 or, respective, VR2 are increased slightly to the potential values VW3, VG3 or, respectively, VR3.

In step S4, the momentary potential VB4 on the surface of the surface elements covered with blue toner particles is reduced to about −380 V with the assistance of the charging means 84. Due to the self-discharge of the photoconductor 60, the potentials VW3, VG3 or, respectively, VR3 are raised in step S4 to the potentials VW4, VG4, or, respectively, VR4.

In step S5—due to the light emitted by the total illumination unit 86—the potentials VW4, VG4 or, respectively, VR4 is increased by respectively approximately 400 V to the potentials VW5, VG5 or, respectively, VR5 on photoconductive not covered with toner particles. The potential on surface elements that ware illuminated with the second optical energy level in step S2 becomes the highest (most positive) momentary potential VR5 on one of the surface elements in step S5 due to the further illumination in step S5. The potential VB4 is increased slightly due to the self-discharge of the photo conductor 60 to the potential VB5. A difference of approximately 400 V exists between the potentials VR5 and VB5, so that toner particles can be applied onto the surface elements in step S6, similar to step S3, these having a potential of greater than −380 V. However, this is now true of the surface elements that were illuminated with the second optical energy in step S2.

In step S6, negative, red toner particles are deposited by the developer station 88. The auxiliary electrode 122 in the immediate proximity of the photo conductor 60 has the auxiliary potential VBIAS6 of approximately −370 V. The negatively charged, red toner particles are situated on the auxiliary electrode 122. Since the potential VBIAS6 is higher than the potentials VW6, VG6 and VB6, these potentials are negative with respect to the potential VBIAS6. The negatively charged, red toner particles, however, can only be deposited on a surface that momentarily has a higher or, respectively, positive potential with respect to the potential VBIAS6. This is only true of surface elements that were illuminated with the second optical energy level in the step S2. Accordingly, the red toner particles are deposited onto these surface elements. Due to the deposit of the negatively charged, red toner particles, the potential on the surface elements covered with red toner particles is reduced to a potential value VR6. Due to the self-discharge of the photo conductor 60, the potentials VW5 , VG5 or, respectively, VB5 are slightly increased to the potential values VW6, VG6, or, respectively, VB6.

In step S7, the potential VR7 on the surface of the surface elements covered with red toner particles is reduced to approximately −360 V with the assistance of the charging means 90. Due to the self-discharge of the photo conductor 60, the potentials VW6, VG6 or, respectively, VB6 are increased to the potentials VW7, VG7 or, respectively, VB7 in step S7.

In step S8—due to the light emitted by the total illumination unit 92 —, the potential VW7 or, respectively, VG7 is raised by respectively approximately 400 V to the potentials VW8 or, respectively, VG8 on the surface elements not covered with toner particles. The potential on surface the elements that were illuminated with the first optical energy level in step S2 becomes the highest potential VG8 on one of the surface elements in step S8 due to the further illumination in step S8. The potentials VB7 and VR7 increase slightly to the potentials VB8 or, respectively, VR8 due to the self-discharge of the photo conductor 60. A difference of approximately 400 V exists between the potentials VR8 and VG8, so that toner particles can be applied onto the surface elements that have a potential greater than −360 V, similar to steps S3 and S6. However, this now affects surface elements that were illuminated with the first optical energy level in step S2.

In step S9, negatively charged, green toner particles are deposited by the developer station 94. The auxiliary electrode 124 in the proximity of the photo conductor 60 has the auxiliary potential VBIAS9 of approximately −350 V. The negatively charged, green toner particles are situated on the auxiliary electrode 124. Analogous to the electrical conditions described in step S3 or, respectively, S6, the negatively changed toner particles are applied onto the surface elements that were illuminated with the first optical energy in the step S2. Due to the deposit of the negatively charged, green toner particles, the potential on the surface elements covered with green toner particles is lowered to a potential value VG9. The potentials VW8, VB8 or, respectively, VR8 increase to the potential values VW9, VB9 or, respectively, VR9 due to the self-discharge of the photo conductor 60.

In step S10, the strip of the photo conductor 60 under consideration is conducted past the recharging station 96. The recharging station 96 contains a corona means that effects a recharging of the layer system to approximately −1200 V. The corona stations has a potential value of approximately −1200 V. When transported past the recharging station, the potentials on all surface elements are significantly reduced.

In a step S11 not show in FIG. 3, the toner particles—due to the influence of the positively charged corona means 70—which are on the surface elements or regions covered with toner particles are transferred onto the carrier material 18, essentially retaining their positions relative to one another. The potential of the surface elements of the photo conductor 60 thereby arises is increased to approximately −400 V. The residual charge which is still present on the photo conductor 60 is removed by the erasing means 98, so that the photo conductor 60 has a potential value of approximately 0 V on its surface after passing the erasing means 98.

FIGS. 4*a*–4*i* show the condition of surface elements of the photo conductor 60 at the end of the steps S1 through S11.

Figures 4A, 4B, 4C, 4D, 4E, 4F, 4G, 4H, 4I:
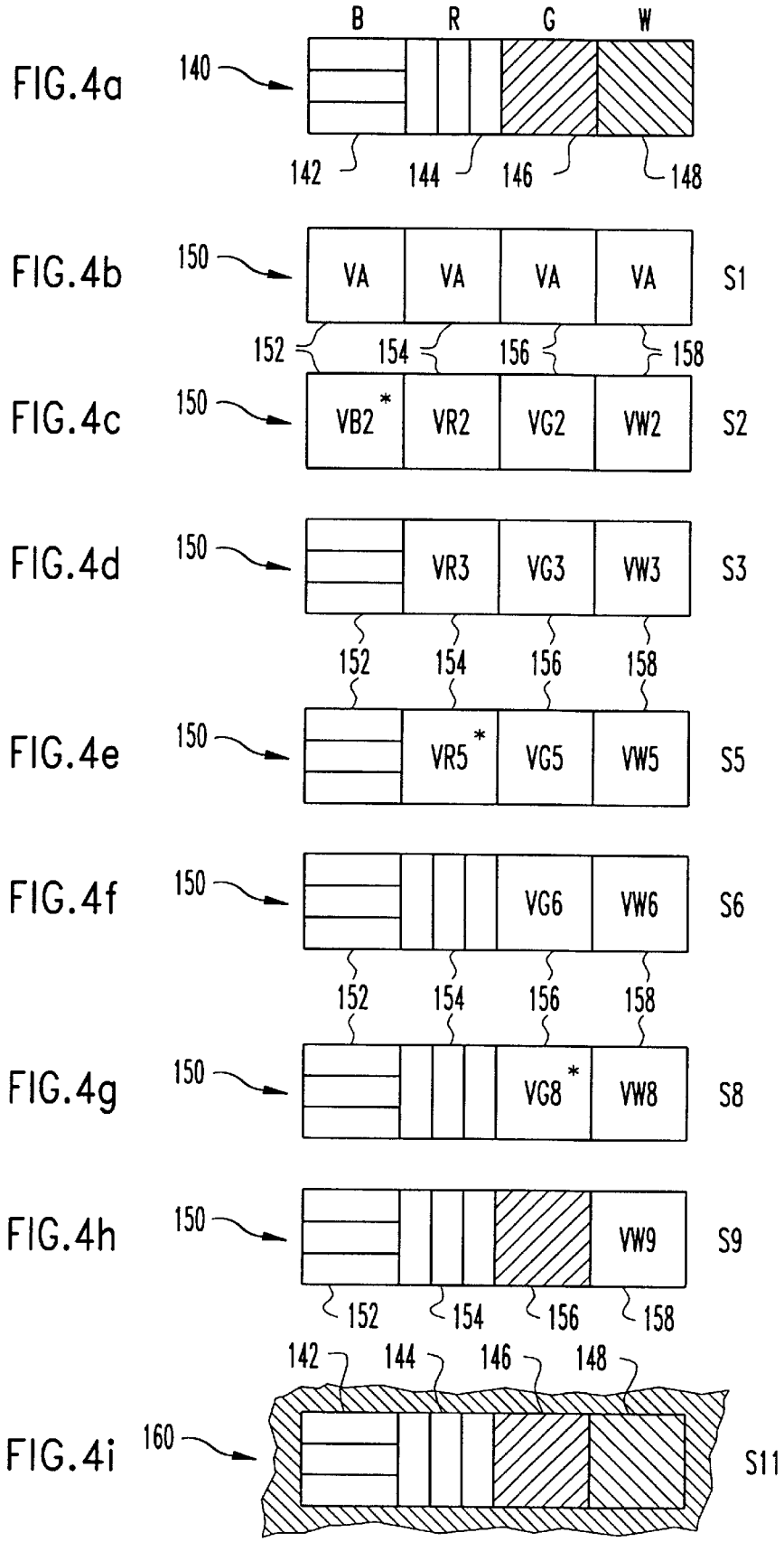
FIGS. 4*a*–4*i* are illustrations of image elements showing the condition of surface elements of the photo conductor in various method steps.
Figure 5:
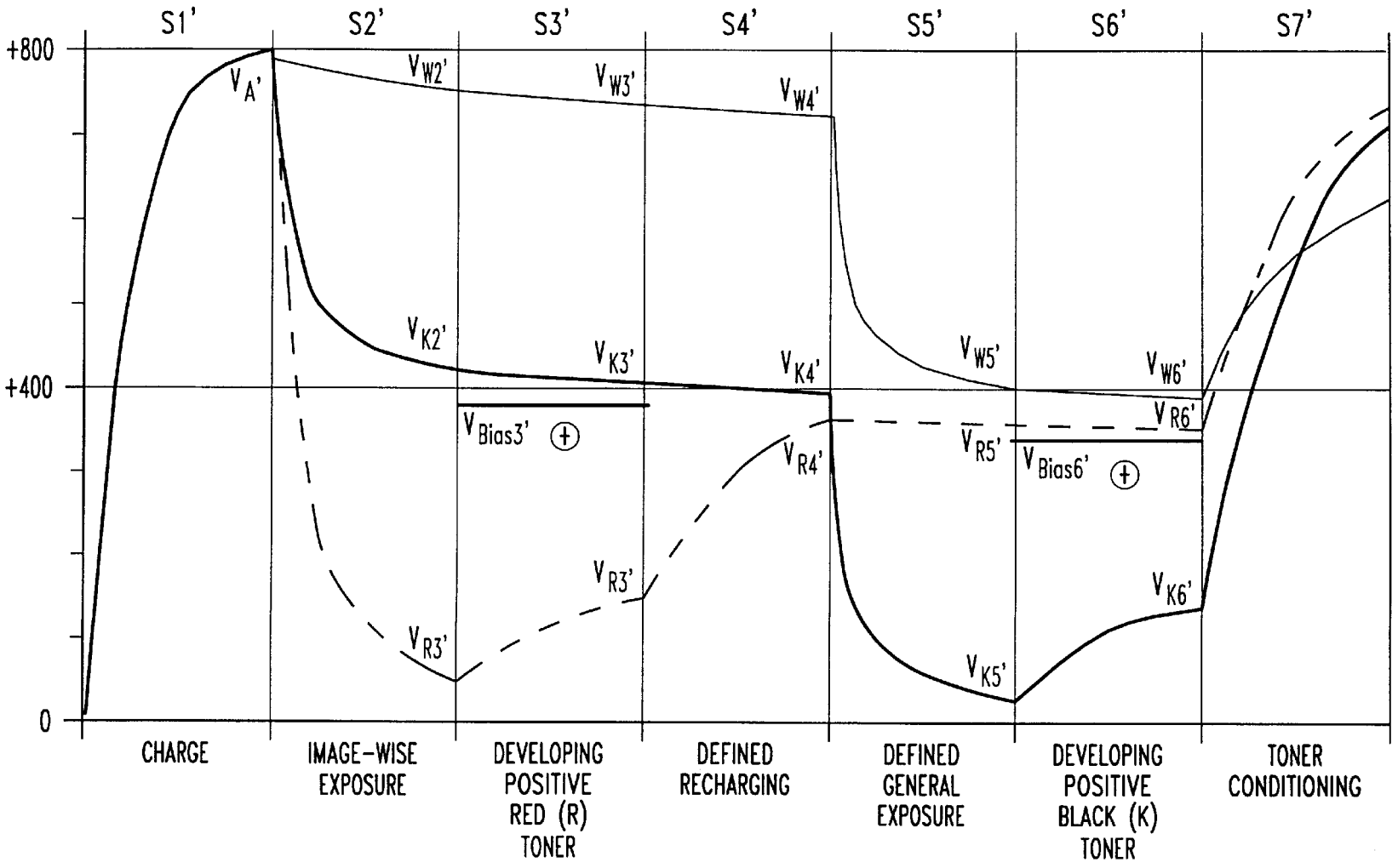
FIG. 5 is a graph of a second curve of potential on selected surface elements of the photo conductor given an exposing step and a toner polarity.

FIG. 4*a* shows a print image 140 that contains four picture elements 142 through 148. The picture element 142 has the color blue B that is shown in FIG. 4*a* by a horizontal hatching. The picture element 144 has the color red R that is shown in FIG. 4*a* by a vertical hatching. The picture element 146 has the color green G, which is shown in FIG. 4*a* by a slanting hatching whose hatching lines are arranged at approximately 45° relative to the horizontal. The picture element 148 has the color white W (which is the color of the carrier material, although other colors of carrier material may of course be used 18) that is shown in FIG. 4*a* with a hatching whose hatching lines are lined at approximately an angle of 135° with reference to the horizontal.

FIG 4*b* shows a strip-shaped section 150 of the photo conductor 60. The section 150 is arranged on the photo conductor 60 transversely relative to the conveying direction 76. The section 150 is shown in plan view in FIG. 4*b*, whereby the photo conductor layer 74 points up. Due to the print control 34, surface elements 152 through 158 on the surface of the photo conductor 60 have the picture elements 142 through 148 allocated to them. The surface element 152 is allocated to the picture element 142. The surface element 154, 156 or, respectively, 158 is allocated to the picture element 144, 146 or, respectively, 148. The allocation ensues such that neighboring surface elements are also allocated to neighboring picture elements of the print image 140. In step S1, the initial potential VA is generated by the charging means 78 on each of the surface elements 152 through 158.

FIG. 4*c* shows the condition of the surface elements 152 through 158 after the image-wise illumination in step S2. Since the highest, third optical energy is incident onto the surface element 152, a charge dismantling occurs via the photo conductor 74 that is highly conductive in the area of the surface element 152 due to the light incidence. As a result thereof, the potential VB2 occurs on the surface of the surface element 152. The surface element 154 is illuminated with the second optical energy that is lower than the third optical energy. Accordingly, the potential VR2 that is lower compared to the potential VB2 occurs on the surface of the surface element 154. After being illuminated with the first optical energy in step S2, the potential VG2 is established on the surface of the surface element 156. Since the first optical energy is lower than the second optical energy, the potential VG2 is lower than the potential VR2. The surface element 158 is not illuminated in the image-wise illuminating. Accordingly, the potential VW2 that lies only slightly above the initial potential VA is established on the surface of the surface element 158 at the end of the image-wise illuminating step S2.

In FIG. 4*c*, a surface element not covered with toner particles that has the highest potential at the end of one of the steps S1 through S11 is identified by an asterisk in the upper right corner of the respective surface element. The surface element 152 has the highest potential in FIG. 4*c*. *FIG. 4c* shows the surface potentials on the surface elements 152 through 158 at the end of the step S3. During step S3, the section 150 is conveyed past the developer station 82. For the aforementioned reasons, blue toner particles deposit only on the surface of the surface element 152, so that this surface element is completely covered with blue toner particles (as indicated by horizontal hatching).

FIG. 4*e* shows the surface elements 152 though 158 at the end of the step S5 in which the section 150 was uniformly illuminated. Due to the uniform illumination, an increase in potential occurs on the surface of the surface elements 154, 156 and 158 that are not covered with toner particles since, as already mentioned, the incident light reduces the resistance of the photo conductor layer 74 and a partial charge carrier compensation between charge carriers on the surface of these surface elements and charge carriers in the electrode layer 72 occurs. At the end of the step S5, the surface element 154 has the highest potential on its surface.

FIG. 4*f* shows the surface elements 152 through 158 at the end of the step S6. During the course of this step, the section 150 is conveyed past the developer station 88. For the aforementioned reasons, red toner particles deposit on the surface element 154 (as indicated by vertical hatching). The surface elements 152 and 154 are thus covered with toner particles.

FIG. 4*g* shows the surface elements 152 through 158 at the end of the step S8 in which the section 150 is uniformly illuminated for the second time. Due to the uniform illumination, an increase in potential occurs on the surface of surface elements that are not covered with toner particles, as likewise occurs in step S5. In step S8, this relates to the surface elements 156 and 158. The potential on the surface elements 156 and 158 is respectively raised by approximately 400 V on the surface elements 156 and 158. At the end of the step S8, the surface element 156 has the highest potential on its surface.

FIG. 4*h* shows the surface elements 152 through 158 at the end of the step S9. In step S9, the section 150 is conveyed past the developer station 94. For the aforementioned reasons, green particles are thereby deposited on the surface element 152, (as indicated by 45° hatching), so that the surface elements 152, 154 and 156 are now covered with toner particles.

FIG. 4*i* shows a section 160 of the carrier material 18 at the end of the step S11. The toner particles on the section 150 are transferred onto the section 160 of the carrier material 18, essentially retaining their mutual positions. As already mentioned, the carrier material 18 has the color white W (135° hatching), so that the print image 140 having the picture elements 142 through 148 was printed onto the section 160 of the carrier material 18 as a result of the described method.

When printing with the printer 10, for example given a resolution of 600 picture element per 25.4 mm, an image elements has a width of approximately 0.044 mm, so that the illustrations in FIG. 4*a*–4*i* a great enlargement with a magnification factor of approximately 200. The human eye can not individually resolve the picture elements given a standard reading distance of approximately 30 cm. Accordingly, mixed color effects derive. The blue picture element 142 and the red picture element 144, for example, yield the mixed color violet as perceived by the eye.

Proceeding from the above-described method for three colors, one arrives at a method with n colors in that the initial potential VA is selected approximately equal to n times the potential required for an individual developing step. In the image-wise illuminating, moreover, at least n different optical energies must be generated per picture element, so that n+1 different potentials can be generated. Steps S7 through S9 are repeated a further n+3 times following the step S9. The letter n is thereby a natural number that can assume the values 4, 5, etc.

Although other modifications and changes may be suggested by those skilled in the art, it is the intention of the inventors to embody within the patent warranted hereon all changes and modification as reasonably and properly come within the scope of their contribution to the art.

What is claimed is:

1. A method for electrophotographic printing of a print image with a plurality of colors on a carrier, comprising the steps of: providing the print image with at least a first image element having a color of the carrier, at least one second image element having a second color, at least one third image element having a third color, and at least one further image element having a further color, providing a photo conductor layer and an electrode layer carrying a predetermined reference potential are contained in a layer system, allocating a first surface element of the photo conductor layer to the first image element, allocating a second surface element of the photo conductor layer to the second image element, allocating a third surface element of the photo conductor layer to the third image element, allocating a further surface element of the photo conductor layer to the further image element, charging the first and second and third and further surface elements to a starting potential of a first polarity;

differently illuminating the surface elements such that the second surface element has a second potential and the third surface element has a third potential, the second potential being higher in amount compared to the third potential and the further surface element has a further potential that is higher in amount compared to the second potential and the first surface element has a first potential that is higher in terms of amount compared to the further potential following illumination;

developing the surface elements with color particles of the third color including depositing color particles of the first polarity and of the third color on the third surface element upon employment of a first auxiliary electrode that has a first auxiliary potential that is higher in terms of amount than a momentary potential on the third surface element and lower in terms of amount than a momentary potential on the second surface element;

arranging the surface elements close to a means for increasing potential so that the potential on the third surface element is increased in terms of amount after application of the color particles of the third color, arranging the surface elements close to a light source having an approximately uniform light distribution so that the third surface element covered with color particles is illuminated substantially less than the first surface element which is free of covering by color particles and the further surface element which is free of covering by color particles and the second surface element which is free of covering by surface particles which causes a momentary potential on the second surface element to be reduced in terms of amount to a potential that is lower in terms of amount than a momentary potential on the third surface element;

developing the surface elements with color particles of the second color by depositing charged color particles of the first polarity and of the second color on the second surface element upon employment of a second auxiliary electrode that has a second auxiliary potential that is higher in terms of amount than a momentary potential on the second surface element and lower in terms of amount than a momentary potential on the third surface element and a momentary potential on the first surface element;

arranging the surface elements close to a further means for increasing potential to cause the potential on the second surface element to be increased in terms of amount after application of the color particles of the second color;

arranging the surface elements close to a further light source so that the further surface element which is free of covering by color particles is respectively considerably more illuminated that surface elements covered with color particles which causes the potential on the further surface element to be reduced in terms of amount to a potential that is lower in amount than a momentary potential on the second surface element; and developing the surface elements with color particles of the further color so that color particles of the first polarity and of the further color are deposited on the further surface element upon employment of a further auxiliary electrode that has a further auxiliary potential that is higher in amount than a momentary potential on the further surface element and lower in amount than momentary potentials on other of the surface elements.

2. A method according to claim 1, further comprising the step of:

bringing deposited color particles to approximately a same value of potential.

3. A method according to claim 1, further comprising the step of:

transferring deposited color particles onto the carrier from the photo conductor layer while substantially retaining their mutual positions.

4. A method according to claim 1, further comprising the step of:

transferring deposited color particles onto an intermediate carrier while substantially retaining their mutual positions, and transferring the color particles from the intermediate carrier onto the carrier while substantially retaining, their mutual positions.

* * * * *